US006506076B2

(12) United States Patent
Cohen et al.

(10) Patent No.: US 6,506,076 B2
(45) Date of Patent: Jan. 14, 2003

(54) CONNECTOR WITH EGG-CRATE SHIELDING

(75) Inventors: Thomas S. Cohen, New Boston, NH (US); Steven J. Allen, Nashua, NH (US); Marc B. Cartier, Jr., Rochester, NH (US)

(73) Assignee: Teradyne, Inc., Boston, MA (US)

( * ) Notice: Subject to any disclaimer, the term of this patent is extended or adjusted under 35 U.S.C. 154(b) by 0 days.

(21) Appl. No.: 09/774,763

(22) Filed: Jan. 31, 2001

(65) Prior Publication Data

US 2001/0046810 A1 Nov. 29, 2001

Related U.S. Application Data

(60) Provisional application No. 60/179,722, filed on Feb. 3, 2000.

(51) Int. Cl.[7] ..... H01R 13/648
(52) U.S. Cl. ..... 439/608
(58) Field of Search ..... 439/608, 609

(56) References Cited

U.S. PATENT DOCUMENTS 5,660,551 A 8/1997 Sakurai ..... 439/108
6,210,227 B1 * 4/2001 Yamasaki et al. ..... 439/608
6,231,391 B1 * 5/2001 Ramey et al. ..... 439/608

FOREIGN PATENT DOCUMENTS

| | | |
|---|---|---|
| EP | 0337634 A1 | 10/1989 |
| EP | 0907225 A2 | 4/1999 |
| WO | WO94/16477 | 7/1994 |

* cited by examiner

*Primary Examiner*—Tho D. Ta
(74) *Attorney, Agent, or Firm*—Teradyne Legal Dept.

(57) ABSTRACT

A high speed, high density electrical connector for use with printed circuit boards is described. The connector is in two pieces, each piece including columns of signal contacts and shield plates which interconnect when the two pieces are mated. The shield plates are disposed in each piece of the connector such that, when mated, the shield plates are substantially perpendicular to the shield plates in the other piece of the connector. The shields have a grounding arrangement that is adapted to control the electromagnetic fields for various system architectures, simultaneous switching configurations and signal speeds. Additionally, at least one piece of the connector is manufactured from wafers, with each ground plane and signal column injection molded into components which, when combined, form a wafer.

22 Claims, 11 Drawing Sheets

CONNECTOR WITH EGG-CRATE SHIELDING

RELATED APPLICATION INFORMATION

This application claims priority to U.S. application No. 60/179,722 filed Feb. 3, 2000.

BACKGROUND OF THE INVENTION

Electrical connectors are used in many electronic systems. It is generally easier and more cost effective to manufacture a system on several printed circuit boards that are then joined together with electrical connectors. A traditional arrangement for joining several printed circuit boards is to have one printed circuit board serve as a backplane. Other printed circuit boards, called daughter boards, are connected through the backplane.

A traditional backplane is a printed circuit board with many connectors. Conducting traces in the printed circuit board connect to signal pins in the connectors so signals may be routed between the connectors. Daughter boards also contain connectors that are plugged into the connectors on the backplane. In this way, signals are routed among the daughter boards through the backplane. The daughter cards often plug into the backplane at a right angle. The connectors used for these applications contain a right angle bend and are often called "right angle connectors."

Connectors are also used in other configurations for interconnecting printed circuit boards, and even for connecting cables to printed circuit boards. Sometimes, one or more small printed circuit boards are connected to another larger printed circuit board. The larger printed circuit board is called a "mother board" and the printed circuit boards plugged into it are called daughter boards. Also, boards of the same size are sometimes aligned in parallel. Connectors used in these applications are sometimes called "stacking connectors" or "mezzanine connectors."

Regardless of the exact application, electrical connector designs have generally needed to mirror trends in the electronics industry. Electronic systems generally have gotten smaller and faster. They also handle much more data than systems built just a few years ago. These trends mean that electrical connectors must carry more and faster data signals in a smaller space without degrading the signal.

Connectors can be made to carry more signals in less space by placing the signal contacts in the connector closer together. Such connectors are called "high density connectors." The difficulty with placing signal contacts closer together is that there is electromagnetic coupling between the signal contacts. As the signal contacts are placed closer together, the electromagnetic coupling increases. Electromagnetic coupling also increases as the speed of the signals increase.

In a conductor, electromagnetic coupling is indicated by measuring the "cross talk" of the connector. Cross talk is generally measured by placing a signal on one or more signal contacts and measuring the amount of signal coupled to the contact from other neighboring signal contacts. In a traditional pin in box connector mating in which a grid of pin in box matings are provided, the cross talk is generally recognized as a sum total of signal coupling contributions from each of the four sides of the pin in box mating as well as those located diagonally from the mating.

A traditional method of reducing cross talk is to ground signal pins within the field of the signal pins. The disadvantage of this approach is that it reduces the effective signal density of the connector.

To make both a high speed and high density connector, connector designers have inserted shield members in proximity to signal contacts. The shields reduce the electromagnetic coupling between signal contacts, thus countering the effect of closer spacing or higher frequency signals. Shielding, if appropriately configured, can also control the impedance of the signal paths through the connector, which can also improve the integrity of signals carried by the connector.

An early use of shielding is shown in Japanese patent disclosure 49-6543 by Fujitsu, Ltd. dated Feb. 15, 1974. U.S. Pat. Nos. 4,632,476 and 4,806,107, both assigned to AT&T Bell Laboratories, show connector designs in which shields are used between columns of signal contacts. These patents describe connectors in which the shields run parallel to the signal contacts through both the daughter board and the backplane connectors. Cantilevered beams are used to make electrical contact between the shield and the backplane connectors. U.S. Pat. Nos. 5,433,617; 5,429,521; 5,429,520 and 5,433,618, all assigned to Framatome Connectors International, show a similar arrangement. The electrical connection between the backplane and shield is, however, made with a spring type contact.

Other connectors have the shield plate within only the daughter card connector. Examples of such connector designs can be found in U.S. Pat. Nos. 4,846,727, 4,975,084, 5,496,183 and 5,066,236, all assigned to AMP, Inc. Another connector with shields only within the daughter board connector is shown in U.S. Pat. No. 5,484,310, assigned to Teradyne, Inc.

A modular approach to connector systems was introduced by Teradyne Connection Systems, of Nashua, New Hampshire. In a connector system called HD+®, multiple modules or columns of signal contacts are arranged on a metal stiffener. Typically, 15 to 20 such columns are provided in each module. A more flexible configuration results from the modularity of the connector such that connectors "customized" for a particular application do not require specialized tooling or machinery to create. In addition, many tolerance issues that occur in larger non-modular connectors may be avoided.

A more recent development in such modular connectors was introduced by Teradyne, Inc. and is shown in U.S. Pat. Nos. 5,980,321 and 5,993,259 which are hereby incorporated by reference. Teradyne, Inc., assignee of the above-identified patents, sells a commercial embodiment under the trade name VHDM™.

The patents show a two piece connector. A daughter card portion of the connector includes a plurality of modules held on a metal stiffener. Here, each module is assembled from two wafers, a ground wafer and a signal wafer. The backplane connector, or pin header, includes columns of signal pins with a plurality of backplane shields located between adjacent columns of signal pins.

Yet another variation of a modular connector is disclosed in patent application Ser. No. 09/199,126 which is hereby incorporated by reference. Teradyne Inc., assignee of the patent application, sells a commercial embodiment of the connector under the trade name VHDM-HSD. The application shows a connector similar to the VHDM™ connector, a modular connector held together on a metal stiffener, each module being assembled from two wafers. The wafers shown in the patent application, however, have signal contacts arranged in pairs. These contact pairs are configured to provide a differential signal. Signal contacts that comprise a pair are spaced closer to each other than either contact is to an adjacent signal contact that is a member of a different signal pair.

SUMMARY OF THE INVENTION

As discussed in the background, higher speed and higher density connectors are required to keep pace with the current trends in the electronic systems industry. With these higher densities and higher speeds however electromagnetic coupling or cross talk between the signal contacts becomes more problematic.

An electrical connector having mating pieces with shields in one piece oriented transversely to the shields in a second piece is therefore provided. In a preferred embodiment, one piece of the connector is assembled from wafers with shields positioned between the wafers. The shields in one piece have contact portions associated therewith for making electrical connection to shield in the other piece. With such an arrangement, a connector is provided that is easily manufactured and possesses improved shielding characteristics.

In other embodiments, the second piece of the connector is manufactured from a metal and includes slots into which signal contacts surrounded by an insulative material are inserted. With such an arrangement, the signal contacts are provided an additional four-walled shield against cross talk.

BRIEF DESCRIPTION OF THE DRAWINGS

The foregoing and other objects, features and advantages of the invention will be apparent from the following more particular description of a Connector with Egg-Crate Shielding, as illustrated in the accompanying drawings in which like reference characters refer to the same parts throughout the different views. For clarity and ease of description, the drawings are not necessarily to scale, emphasis instead being placed upon illustrating the principles of the invention.

DESCRIPTION OF THE PREFERRED EMBODIMENT

Figure 1:
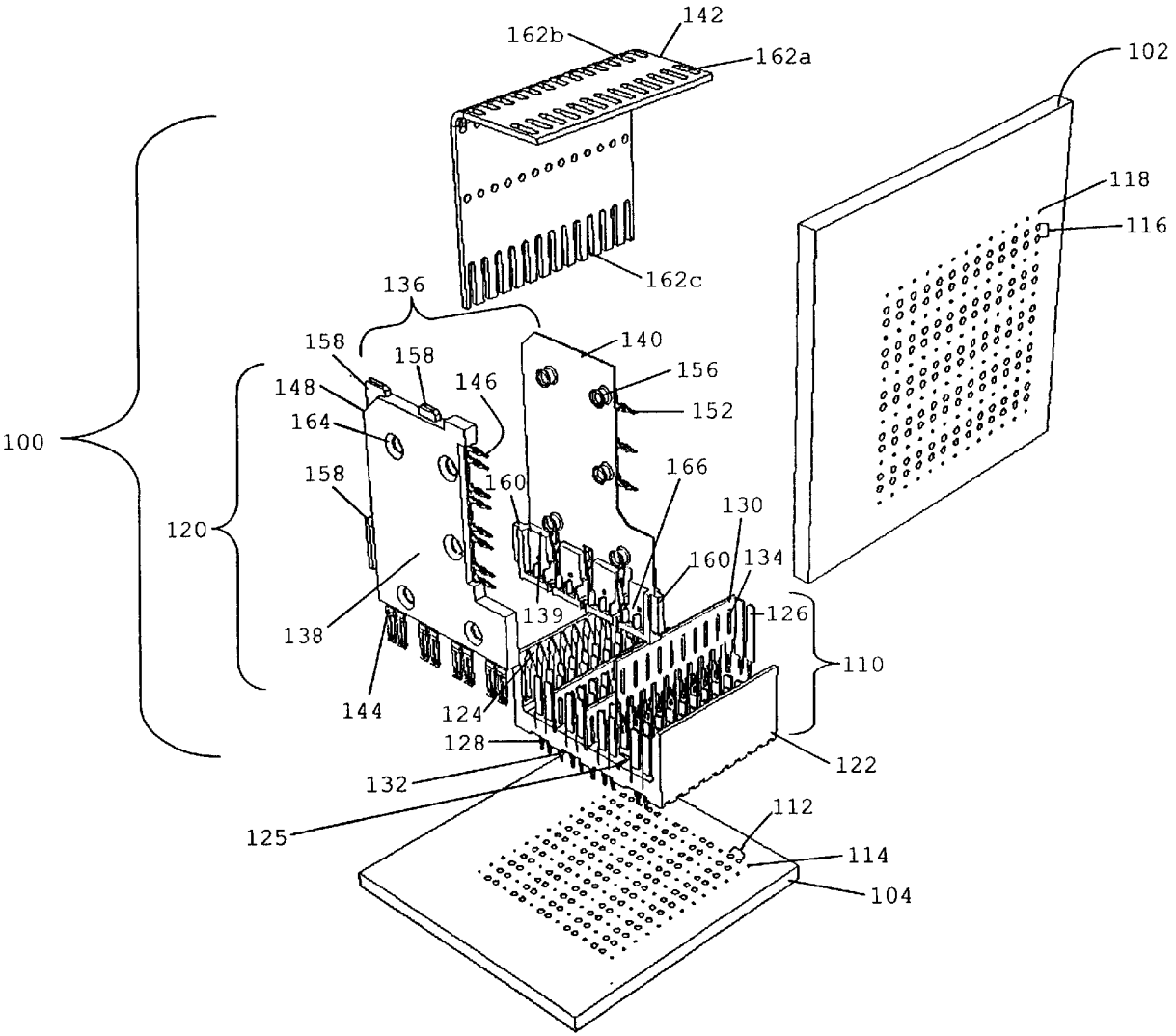
FIG. 1 is an exploded view of a connector assembly made according to one embodiment of the invention.

FIG. 1 is an exploded view of a connector assembly 100 made in accordance with one embodiment of the invention. The connector assembly 100 includes two pieces. The first piece is connected to a daughter card 102 and may be referred to as a daughter card connector 120. The second piece is connected to a backplane 104 and may be referred to as a backplane connector 110. The daughter card connector 120 and backplane connector 110 are intermatable and together form a substrate-to-substrate connector. Here, the connector is shown and will be described as connecting a backplane and daughter card. However, the techniques described herein may also be implemented in other substrate to substrate connectors and also in cable to substrate connectors.

Generally, multiple backplane connectors are connected to a backplane and are aligned side by side. Correspondingly, multiple daughter card connectors are provided on a daughter card to mate with the multiple backplane connectors. Here, for purposes of illustration and ease of description, only a single backplane connector 110 and daughter card connector 120 are shown.

Figure 2:
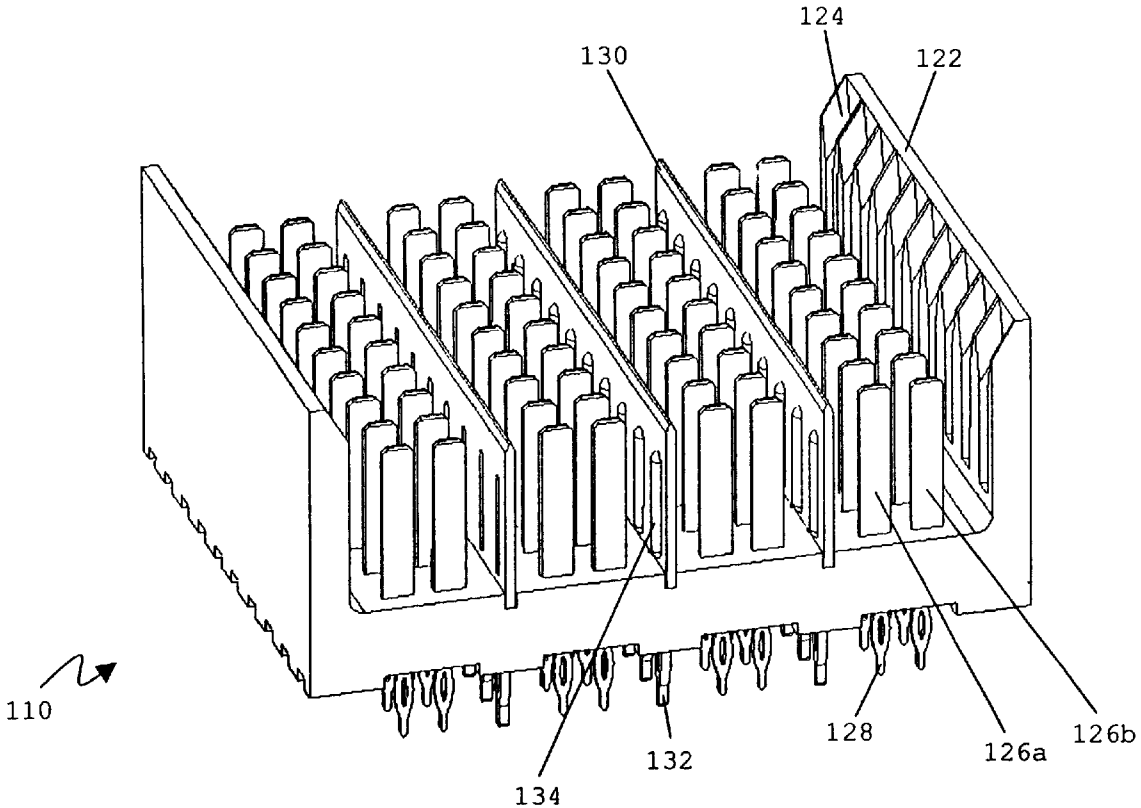
FIG. 2 is the backplane connector of FIG. 1.

Referring also to FIG. 2, the support for the backplane connector 110 is a shroud 122 that is preferably formed by an injection molding process using an insulative material. Suitable insulative materials are a plastic such as a liquid crystal polymer (LCP), a polyphenyline sulfide (PPS), or a high temperature nylon. The shroud 122 includes sidewall grooves 124 in opposing sides of the shroud 122. As will be discussed below, these sidewall grooves 124 are used to align elements of the daughter card connector 120 when the two connectors 110, 120 are mated. Running along a floor of the shroud 122, perpendicular to the sidewall grooves are a plurality of narrow grooves or trenches 125 which receive a backplane shield 130.

The backplane connector 110 includes an array of signal conductors that transfer signals between the backplane 104 and the daughter card 102 when the backplane connector 110 is mated with the daughter card connector 120. Disposed at a first end of the signal conductors are mating contacts 126. In a preferred embodiment, the mating contacts 126 take the form of signal blades 126 and are configured to provide a path to transfer a differential signal. A differential signal is provided by a pair of conduction paths 126*a*, 126*b* which is typically referred to as a differential pair. The voltage difference between the two paths represents the differential signal pair. In a preferred embodiment, there are eight rows of signal blades 126 in each column. These eight signal blades may be configured to provide eight single ended signals or as mentioned above, four differential signal pairs.

The signal blades 126 extend through the shroud 122 and terminate in tail elements 128, which in the preferred embodiment, are adapted for being press fit into signal holes 112 in the backplane 104. Signal holes 112 are plated through holes that connect to signal traces in the backplane 104. FIG. 1 shows the tail elements as "eye of the needle" tails however, the tail elements 128 may take various forms, such as surface mount elements, spring contacts, solderable pins, etc.

Figure 3:
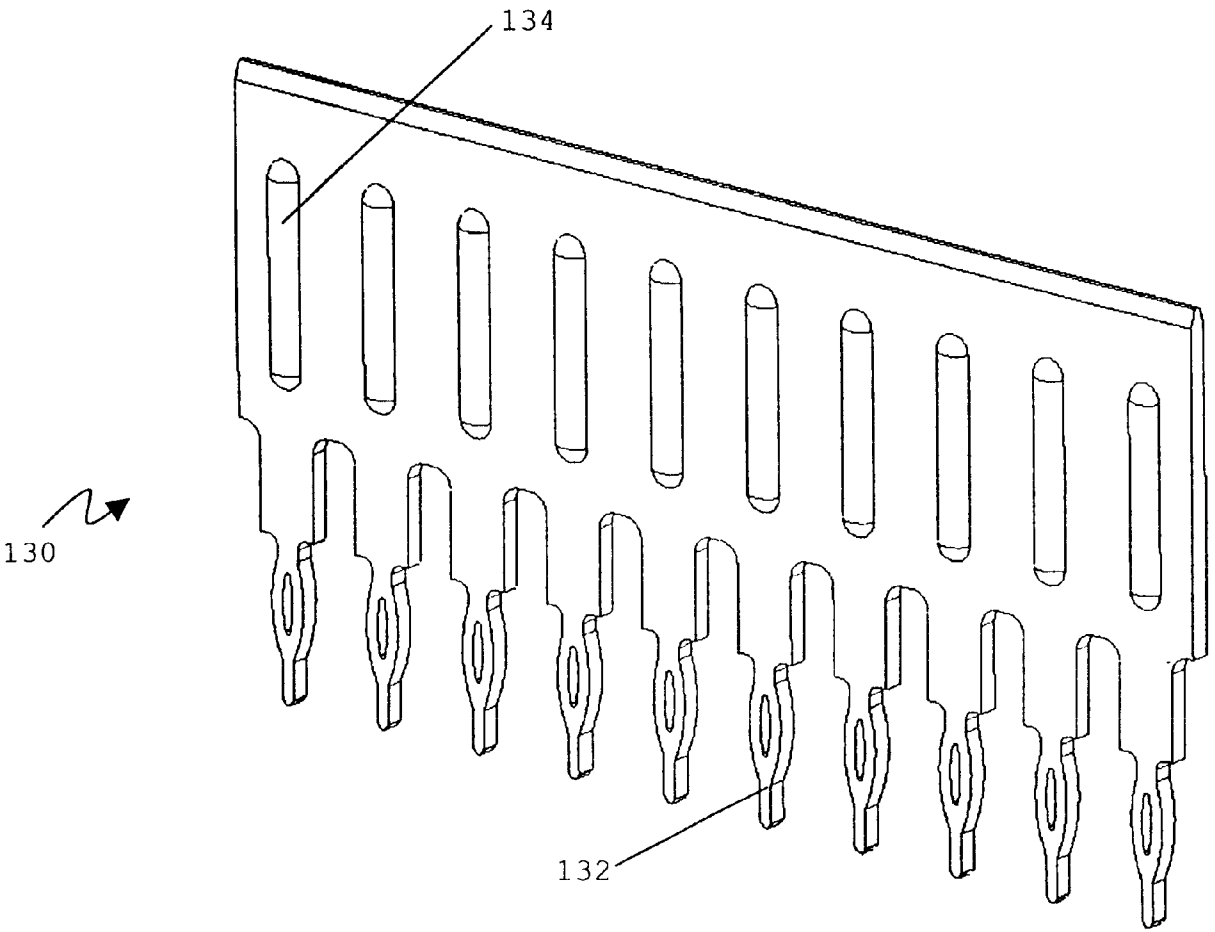
FIG. 3 is the backplane shield plate 130 of FIG. 1.

Referring also to FIG. 3, a plurality of shield plates 130 is provided between the columns of signal blades 126, each disposed within one of the plurality of trenches 125. The shield plates 130 may be formed from a copper alloy such as beryllium copper or, mote typically, a brass or phosphor bronze. The shield plates 130 are also formed in an appropriate thickness in the range of 8–12 mils to provide additional stability to the structure.

In a single-ended embodiment, the shield plates are disposed between the columns of signal blades 126. In the preferred embodiment, the shield plates 130 are disposed between pairs of signal blades 126. The shield plates 130 are substantially planar in form and terminate at a base end in tail elements 132 adapted for being press fit into ground holes 114 in the backplane 104. In the preferred embodiment, the tail elements 132 take the form of "eye of the needle" contacts. Ground holes 114 are plated through holes that connect to ground planes on the backplane 104. In a preferred embodiment, the shield plate 130 includes ten tail elements 132. A beveled edge (not labeled) is provided at the top end of the shield plate 130. In one embodiment, the shield plates 130 include strengthening ribs 134 on a first face of the shield plate 130.

Referring again to FIG. 1, the daughter card connector 120 is a modular connector. That is, it includes a plurality of modules or wafers 136. The plurality of wafers are supported by a metal stiffener 142. Here, a representative section of the metal stiffener 142 is shown. Also shown, is an exemplary wafer 136. In a preferred embodiment, the daughter card connector 120 includes a plurality of wafers stacked side-by-side, each wafer being supported by the metal stiffener 142.

The metal stiffener 142 is generally formed from a metal strip, typically a stainless steel or an extruded aluminum, and is stamped with a plurality of apertures 162. The plurality of apertures 162 are adapted to accept features 158 from each of the plurality of wafers 136 that combine to retain the wafers 136 in position. Here, the metal stiffener 142 includes three apertures 162 to retain the wafer's position; a first 162*a* located at a first end, the second 162*b* located within a substantially ninety degree bend in the metal stiffener and the third 162*c* located at a second end of the metal stiffener 142. When attached, the metal stiffener 142 engages each of two edges on the wafers 136.

Each wafer 136 includes a signal portion 148 and a shielding portion 140. Both the signal portion 148 and shielding portion 140 include an insulative housing 138, 139 which is insert molded from an insulative material. Typical materials used to form the housings 138, 139 include a liquid crystal polymer (LCP), a polyphenyline sulfide (PPS) or other suitable high temperature resistant insulative material.

Disposed within the insulative housing 138 of the signal portion 148 are conductive elements that extend outward from the insulative housing 138 through each of two ends. The conductive elements are formed from a copper alloy such as beryllium copper and are stamped from a roll of material approximately eight mils thick.

At a first end, each conductive element terminates in a tail element 146 adapted to be press fit into a signal hole 116 in the daughter card 102. Signal holes 116 are plated through holes that connect to signal traces in the daughter card 102. At a second end, each conductive element terminates in a mating contact 144. In a preferred embodiment, the mating contact takes the form of a beam structure 144 adapted to receive the signal blades 126 from the backplane connector 110. For each signal blade 126 included in the backplane connector 110, there is provided a corresponding beam structure 144 in the daughter card connector 120.

In a preferred embodiment, eight rows, or four differential pairs, of beam structures are provided in each wafer 136. The spacing between differential pairs as measured across the wafer is 1.6 mm to 1.8 mm. The group to group spacing, also measured across the wafer, is approximately 5 mm. That is, the spacing between repeating, identical features such as between the left signal blade 126 in a first pair and the left signal blade 126 in an adjacent pair is 5 mm.

Included on a third and fourth end of the insulative housing 138 are multiple features 158*a*–158*c* that are inserted into the stiffener apertures 162 to fasten the wafer 136 to the stiffener 142. The features 158*a*, 158*b* on the fourth end take the form of tabs formed in the insulative housing while the feature 158*c* on the third end is a hub which is adapted to provide an interference fit in the third aperture 162*c* in the metal stiffener 142.

The shielding portion of the wafer 136, also referred to as the shield 140, is formed of a copper alloy, typically a beryllium copper, and is stamped from a roll of material approximately eight mils thick. As described above, the shield is also partially disposed in insulative material.

The insulative material on the shield 140 defines a plurality of cavities 166 in which the signal beams 144 reside. Adjacent to these defined cavities 166 on the first and third ends of the wafer 136 are shroud guides 160*a*, 160*b* which engage the sidewall grooves 124 of the backplane connector 110 when the daughter card 120 and backplane 110 connectors are mated, thus aiding the alignment process. The combination of the sidewall grooves 124 and the shroud guides 160*a*, 160*b* prevent unwanted rotation of the wafers 136 and support uniform spacing between the wafers 136 when the backplane connector 110 and the daughter card connector 120 are mated. The wafer pitch, or spacing between the wafers is within the range of 1.75 mm to 2 mm, with a preferred wafer pitch being 1.85 mm.

The sidewall grooves 124 also provide additional stability to the wafers by balancing the forces of the mating contacts. In the preferred embodiment, the signal blades 126 of the backplane connector 110 mate with the signal beams 144 of the daughter card connector 120. The nature of this mating interface is that the forces from the beams are all applied to a single side, or surface of the blades. As a result, the forces provided by this mating interface are all in a single direction with no opposing force available equalize the pressure. The sidewall grooves 124 provided in the backplane shroud 122 equalize this force thus providing stability to the connector 100.

Disposed at a first end of the shield 140 are a plurality of tail elements. Each tail element is adapted to be press fit into a ground hole 118 in the daughter card 102. Ground holes 118 are plated through holes that connect to ground traces in the daughter card 102. In the illustrated embodiment, the shield 140 includes three tail elements 152 however, in a preferred embodiment four tail elements 152 are included. In a preferred embodiment, the tail elements take the form of "eye of the needle" elements.

At a second end of the shield 140 are mating contacts 150. In the illustrated embodiment, the mating contacts 150 take the form of beams that are adapted to receive the beveled edge of the backplane connector shield 130. The resulting connection between the shields 130, 140 provides a ground path between the daughter card 102 and the backplane 104 through the connectors 110, 120.

Figure 4:
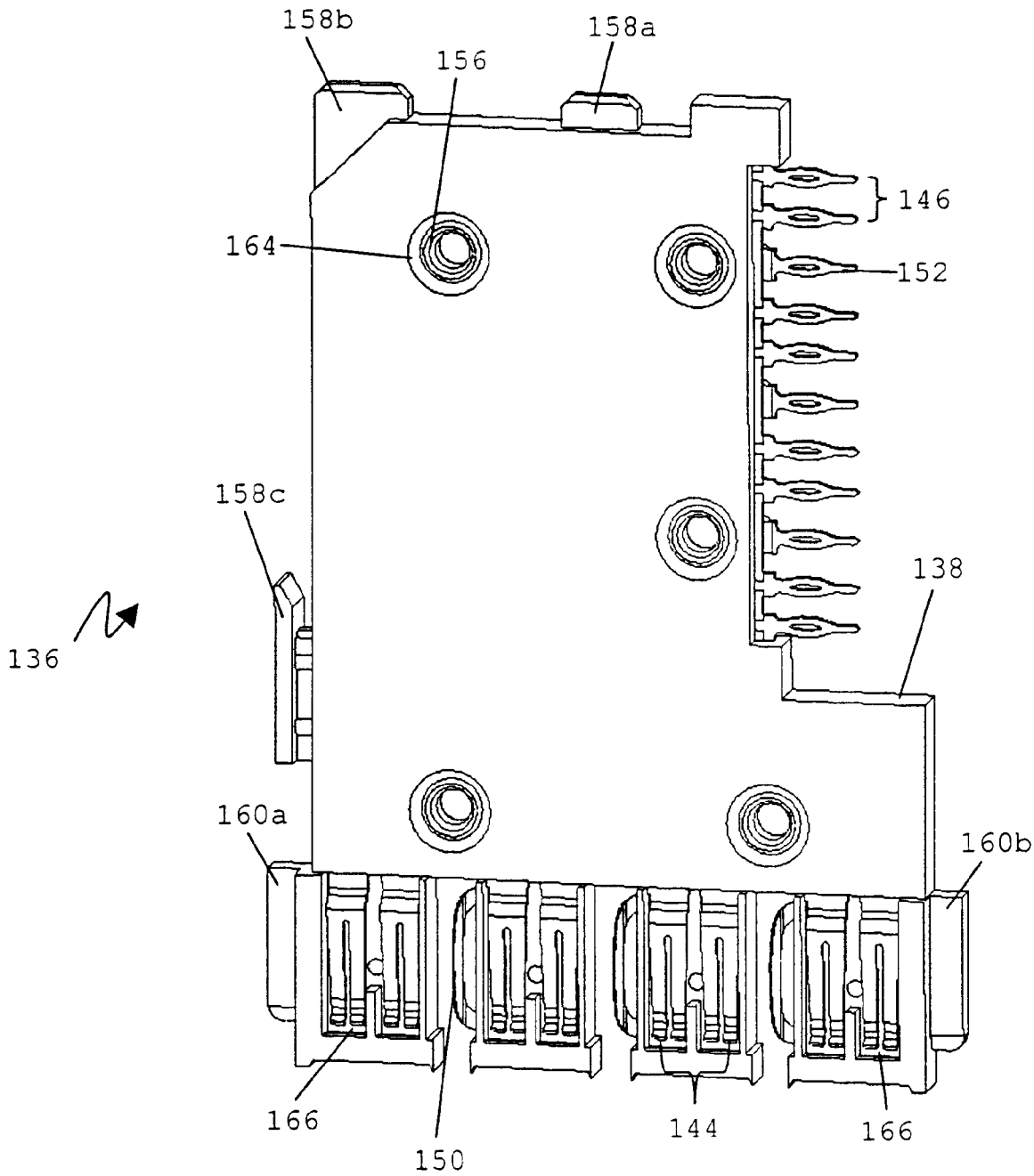
FIG. 4 is an alternate view of a representative signal wafer of FIG. 1.

Referring now to FIG. 4, an assembled wafer is shown. When the signal 148 and ground portions 140 of the wafer 136 are assembled, the signal tail elements 146 and the ground tail elements 152 are disposed in a line defining a single plane. As shown, a single ground tail element 152 is disposed between each pair of signal tail elements 146.

Figure 5:
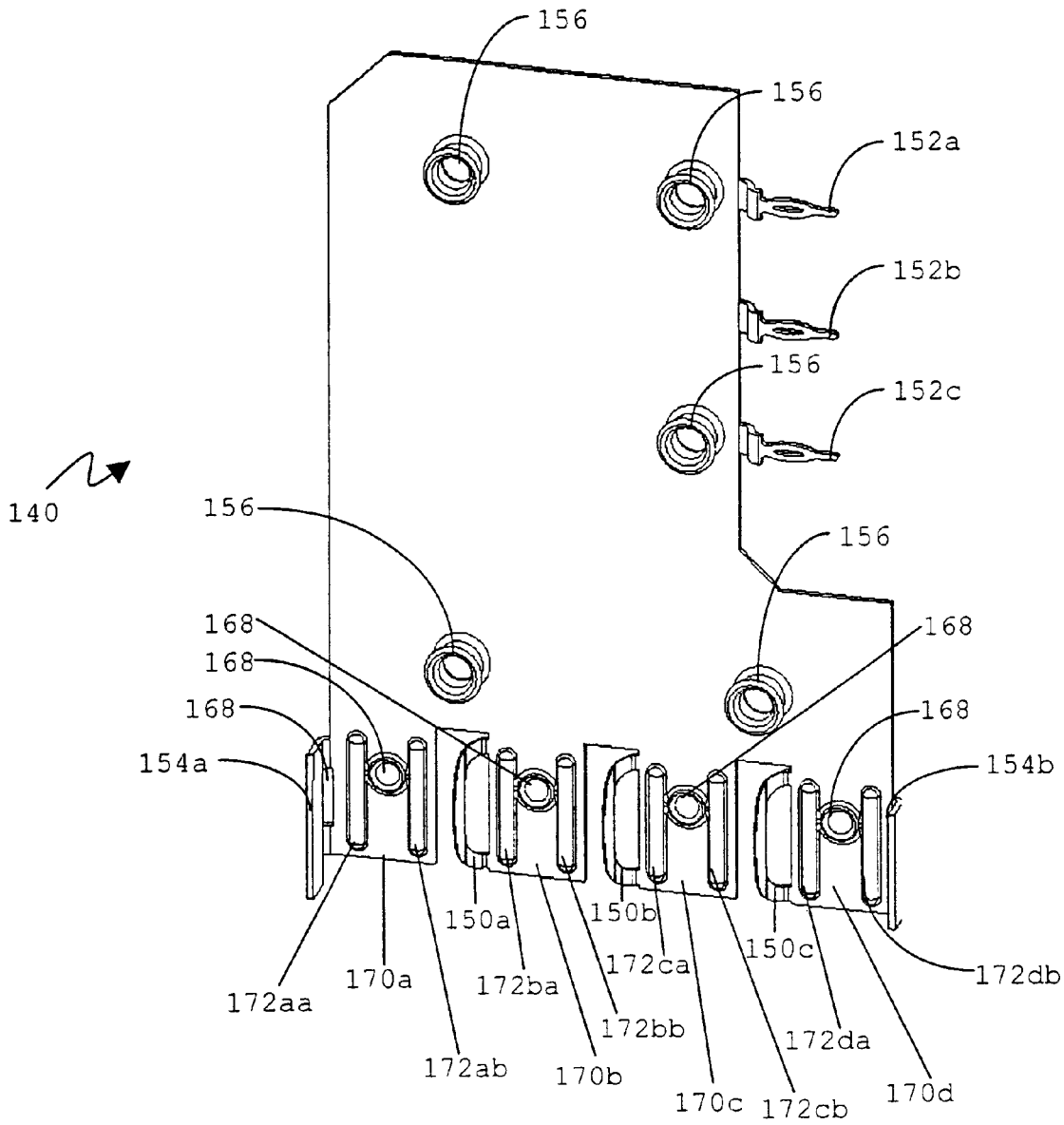
FIG. 5 is a view of the daughter card shield plate 140 of FIG. 1 prior to molding.

Referring now to FIG. 5, the shield 140, as shown before the molding process, includes wings 154*a*, 154*b* disposed on opposing sides of the shield 140. In the finished wafer 136, these wings 154*a*, 154*b* are disposed within the insulative material that forms the shroud guides 160*a*, 160*b*.

Generally, to form the wings 154*a*, 154*b* , the shield 140 is first stamped from a roll of metal, typically a copper alloy such as beryllium copper. The wings 154*a*, 154*b* are bent out of the plane of the shield 140 to form a substantially 90° angle with the shield 140. The resulting wings 154*a*, 154*b* thus form new planes which are substantially perpendicular to the plane of the shield 140.

The shield 140 also includes the tail elements 152*a*–152*c* previously described, the shield termination beams 150*a*–150*c* and a plurality of shield fingers 170*a*–170*d*. The shield fingers 170*a*–170*d* are disposed adjacent to the mating contacts 150*a*–150*c* and between the wings 154*a*, 154*b*. Strengthening ribs 172 are provided on the face of the shield fingers 170*a*–170*d*. In a preferred embodiment, four shield fingers 170*a*–170*d* are provided with two strengthening ribs 172*aa*–172*db* disposed on each shield finger 170*a*–170*d* to oppose the forces exerted by the opposing mating contacts.

Also included on the face of the shield 140 is a plurality of protruding openings or eyelets 156 that serve to hold the shield 140 and signal portion 148 of the wafer 136 together. The signal portion 148 includes apertures or eyelet receptors 164 (FIG. 4) through which these eyelets 156 may be inserted. After insertion, a forward edge (not labeled) of the eyelets 156 may be rolled back to engage the face of the signal portion surrounding the eyelet receptors 164, consequently locking the shield 140 and signal portion 148 together.

The shield 140 is further shown to include flow-through holes 168. Flow-through holes 168 accept the insulative material applied to the shield 140 during the insertion molding process. The insulative material deposits within the flow-through holes 168 thus creating a stronger bond between the insulative material and the shield 140. In a preferred embodiment, a single flow-through hole 168 is provided on the face of each shield finger 170*a*–170*d* and within the bend of each wings 154*a*, 154*b*.

In the illustrated embodiment, mating contacts 150*a*–150*c* are arc shaped beams attached at either end to an edge of one of the shield fingers 170*b*–170*d*. Like the wings 154*a*, 154*b*, the mating contacts 150*a*–150*c* are typically bent out of the plane of the shield 140 after the shield has been stamped. In a preferred embodiment, at least two bends are formed in the shield termination beams 150*a*–150*c* to provide a sufficient spring force.

The gaps (not labeled), which are formed when the mating contacts 150*a*–150*c* are bent into position, receive the beveled edge of the backplane shield 130 when the two connectors 110, 120 are mated. The gaps, however, are not of sufficient width to freely accept the beveled edge of the backplane shield 130. Accordingly, the mating contacts 150*a*–150*c* are displaced by the backplane shield 130. The displacement generates a spring force in the mating contacts 150*a*–150*c* thus providing an effective electrical contact between the shields 130, 140 and completing the ground path between the connectors 110, 120.

Figure 6:
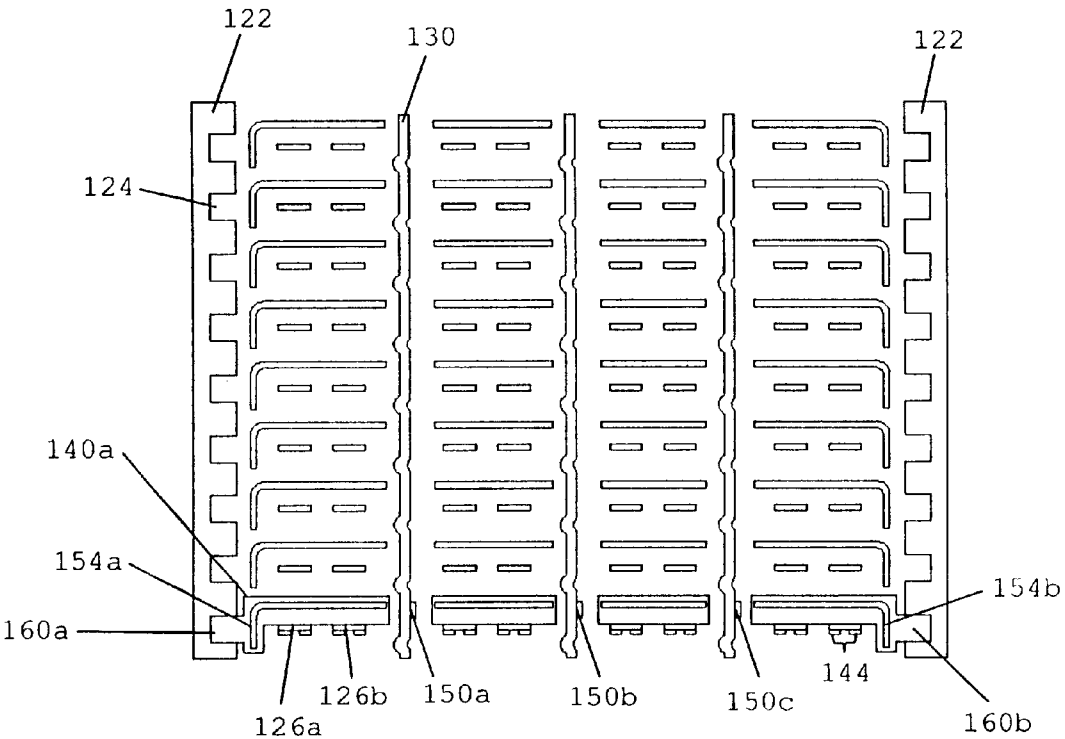
FIG. 6 is a top sectional view of a shielding pattern that results when the two pieces of the connector of FIG. 1 are mated.

FIG. 6 is a top sectional view of a shielding pattern that results when the two pieces of the connector 100 of FIG. 1 are mated. Only certain of the elements of the backplane connector 110 and the daughter card connector 120 are represented in the diagram.

Specifically, the backplane 130 and daughter card 140 shields, the signal blades 126, and the sidewall grooves 124 of the shroud 122 are included. Further shown with respect to a representative daughter card shield 140*a* are an outline representing the insulative material formed around the shield 140*a*, the corresponding beam structures 144 from the daughter card connector 120 and the mating contacts 150.

When mated, the shield plates 130, 140 in each connector 110, 120 form a grid pattern. Located within each cell of the grid is a signal contact. Here, the signal contact is a differential pair comprised of two signal blades 126 from the backplane connector 110 and two beam structures 144 from the daughter card connector 120. In a single-ended embodiment, a single signal blade 126 and a single beam structure 144 comprise the signal contact.

The shield configuration represented in FIG. 6 isolates each signal contact from each neighboring signal contact by providing a combination of one or more of the backplane shields 130 and one or more of the daughter card shields 140 between a signal contact and its adjacent contact. In addition, it should also be noted that the wings 154*a*, 154*b*, located on either side of the daughter card shield 140, further inhibit cross talk between signal contacts that are located adjacent to the shroud 122 sidewalls and additionally form a symmetric ground configuration to provide for a balanced differential pair.

Figure 7:
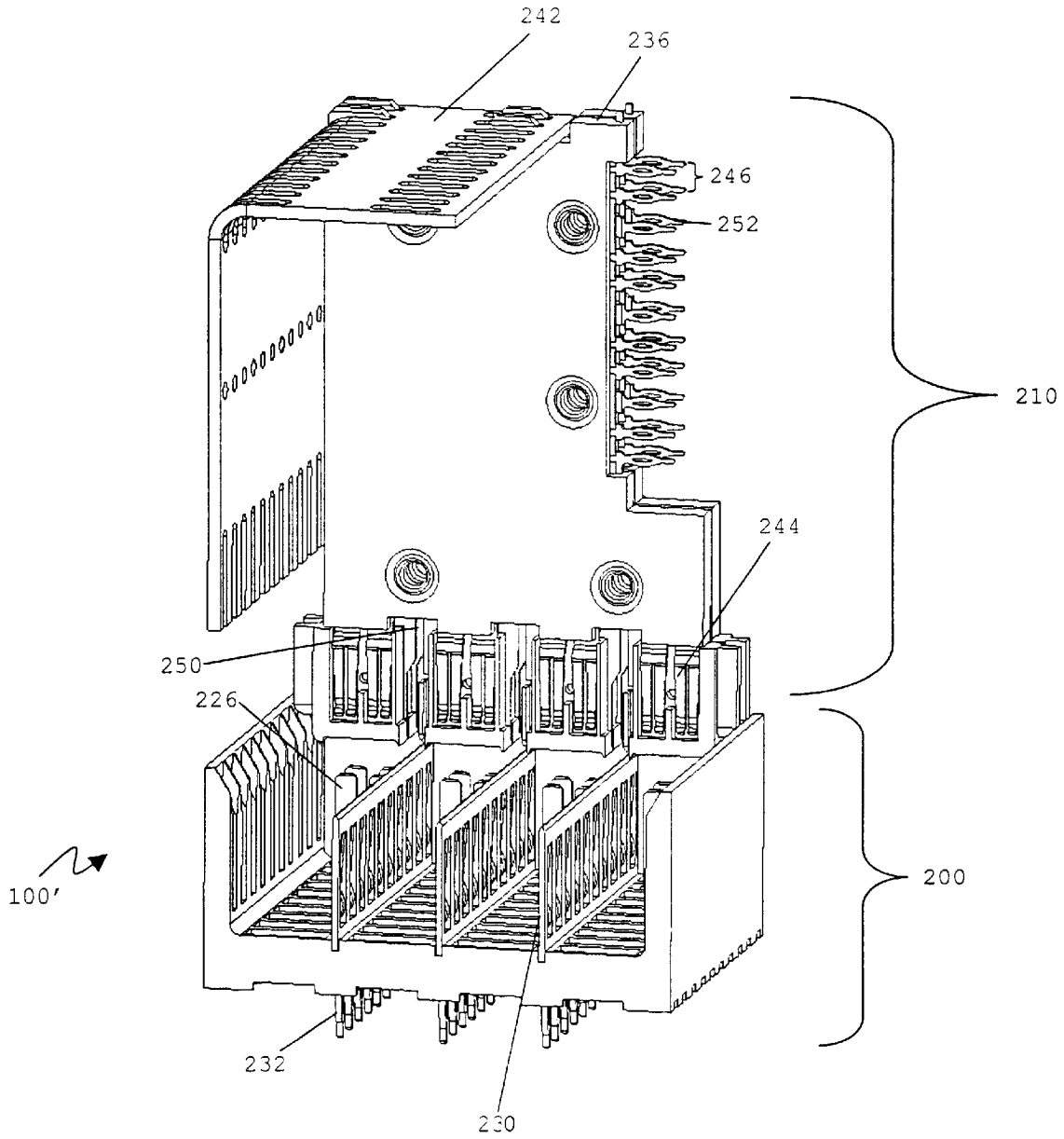
FIG. 7 is an alternate embodiment of the connector 100 of FIG. 1.

Referring now to FIG. 7, an alternate embodiment of the connector 100' is shown. Connector 100' is shown to include a backplane connector 200, and a daughter card connector 210. The daughter card connector 210 includes a plurality of wafers 236 held on a metal stiffener 242. Two representative wafers 236 are shown. The wafers 236 include a plurality of contact tails 246, 252 that are adapted to attach to the first circuit board 102. The wafers further include a plurality of signal beams 244 that are adapted to mate with the signal blades 226 extending from the backplane connector 200.

Disposed between the signal beams 244 is a plurality of mating contacts 250. The mating contacts 250 are adapted to receive a beveled edge of a backplane shield 230 included in the backplane connector 200. The backplane shield 230 is also shown to include a plurality of tail elements 232 adapted to be press fit into the second circuit board 104.

Figure 8:
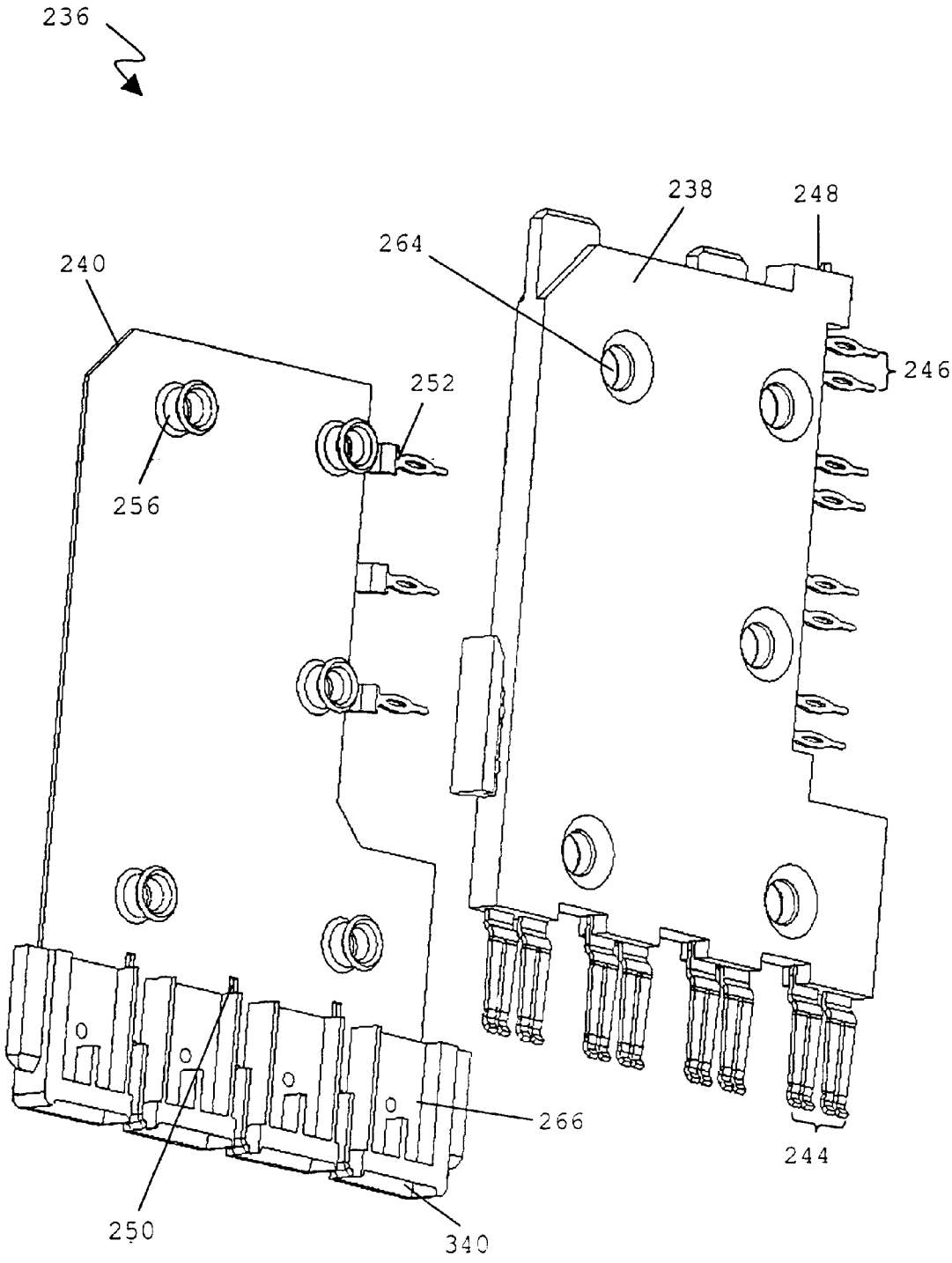
FIG. 8 is an alternate embodiment of the wafer of FIG. 4.

Referring now to FIG. 8, a wafer 236 is shown to include a signal portion 248 and a shield portion 240. The signal portion 248 includes an insulative housing 238 which is preferably insert injection molded. A high temperature, insulative material such as LCP or PPS are suitable to form the insulative housing 238.

The signal portion 248 is shown to include contact tails 246 and signal beams 244. Here the contact tails 246 and signal beams 244 are configured as differential pairs providing a differential signal therefrom, however, a single ended configuration may also be provided. The signal portion 248 also includes eyelet receptors 264 that receive eyelets 256 from the shield portion 240 of the wafer 236. The eyelets 256 are inserted into the eyelet receptors 264 and are rolled radially outward against the surface of the signal portion 248, thus locking the two portions together.

A lower section of the shield portion 240, or shield 240, is insert molded using an insulative material such as LCP or PPS. The insulative housing forms a plurality of cavities 266 that receive the signal beams from the signal portion 248. A floor of each cavity 266 includes an aperture 340 through which the signal blades 226 from the backplane connector 200 access the signal beams 244 of the daughter card connector 210.

The shield 240 is further shown to include contact tails 252 and mating contacts 250. The mating contacts will be described in more detail in conjunction with FIG. 11.

Figure 9:
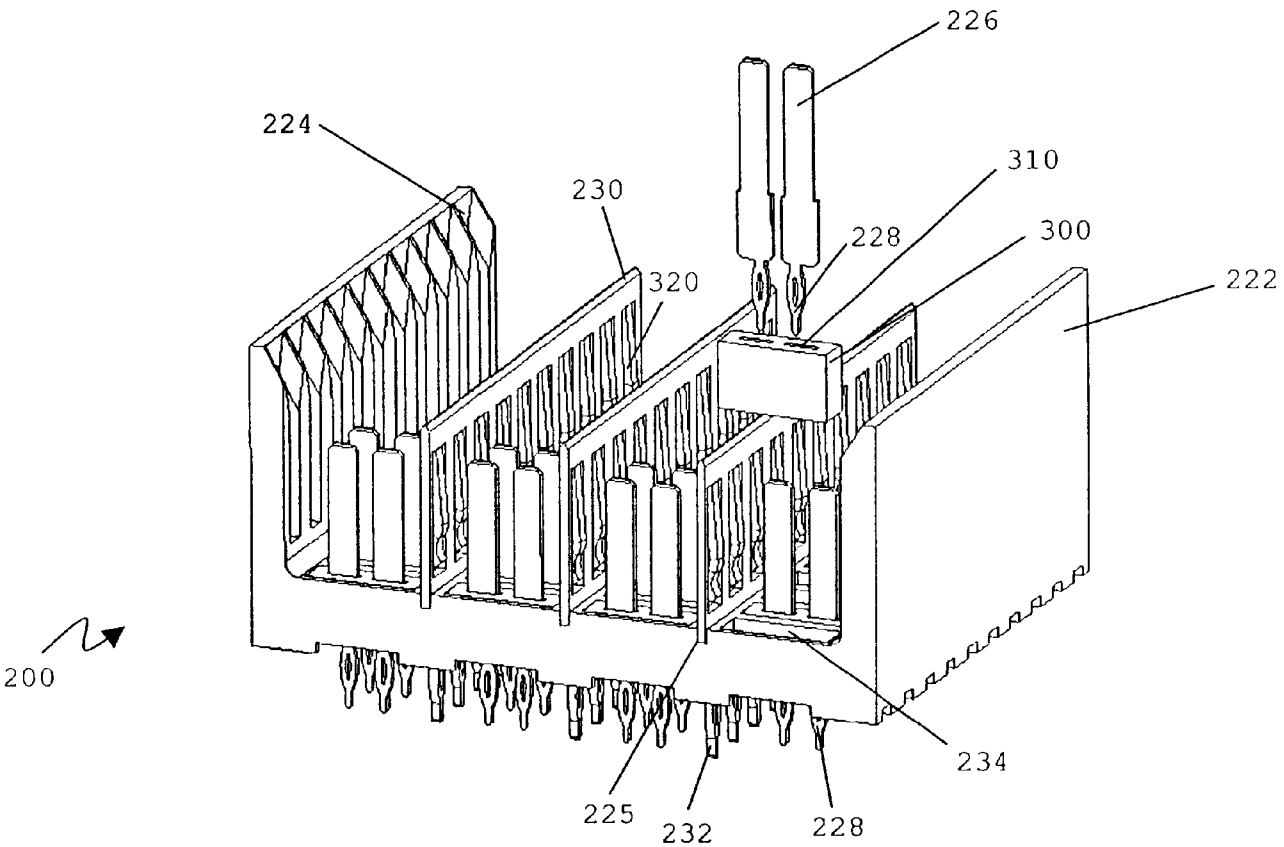
FIG. 9 is an alternate embodiment of the backplane connector of FIG. 2.

Referring now to FIG. 9, the backplane connector 200 is shown to include a shroud 222. The shroud 222 is formed from a metal, preferably a die cast zinc. The shroud includes sidewall grooves 224 that are used, inter alia, to guide the wafers 236 into proper position within the shroud 222. The sidewall grooves 224 are located on opposing walls of the shroud 222.

Located on the floor of the shroud 222 are a plurality of apertures 234 and a plurality of narrow trenches 225. The plurality of apertures 234, here rectangular-shaped, are adapted to receive a block of insulative material 300, preferably molded from an LCP, a PPS or other temperature resistant, insulative material. The insulative block 300 is press fit into the apertures 234 after the shroud has been cast. In a preferred embodiment the plurality of insulative blocks 300 are affixed to a sheet of insulative material to make handling and insertion more convenient.

Each insulative block 300 includes at least one channel 310 that is adapted to receive a signal blade 226. In a preferred embodiment in which connector 100' is configured to transfer differential signals, the insulative block 300 includes two channels 310 to receive a pair of signal blades 226. The signal blades 226 are pressed into the insulative block 300 which, in turn, is pressed into the metal shroud 222. Extending from the bottom of the insulative block 300 are contact tails 228 which are adapted to be press fit into the second circuit board 104.

Here, the rectangular-shaped apertures 234 provide additional shielding from cross talk for signals travelling through the backplane connector 200. The insulative block 300 insulates the signal blades 226 from the metal shroud 222.

The backplane connector 200 is further shown to include a plurality of backplane shields 230 that are inserted into the narrow trenches 225 located on the floor of the metal shroud 222. Extending from the bottom of the metal shroud 222 are the contact tails 232. The backplane shield 230 is shown to include a plurality of shield beams 320. Also included on the backplane shield are means for commoning the grounds or, more specifically, means for electrically connecting the backplane shield 320 to the metal shroud 222. Here the means for commoning the grounds are shown as a plurality of light press fit contacts 231.

The shield beams 320 work in concert with the mating contacts 250 of the wafer 236 to provide a complete ground path through the connector 100'. The interplay of these features as well as additional details regarding the backplane shield 230 and a shield 240 included in the daughter connector 210 wafer 236 will be described more fully in conjunction with FIGS. 10 and 11 below.

Figure 10:
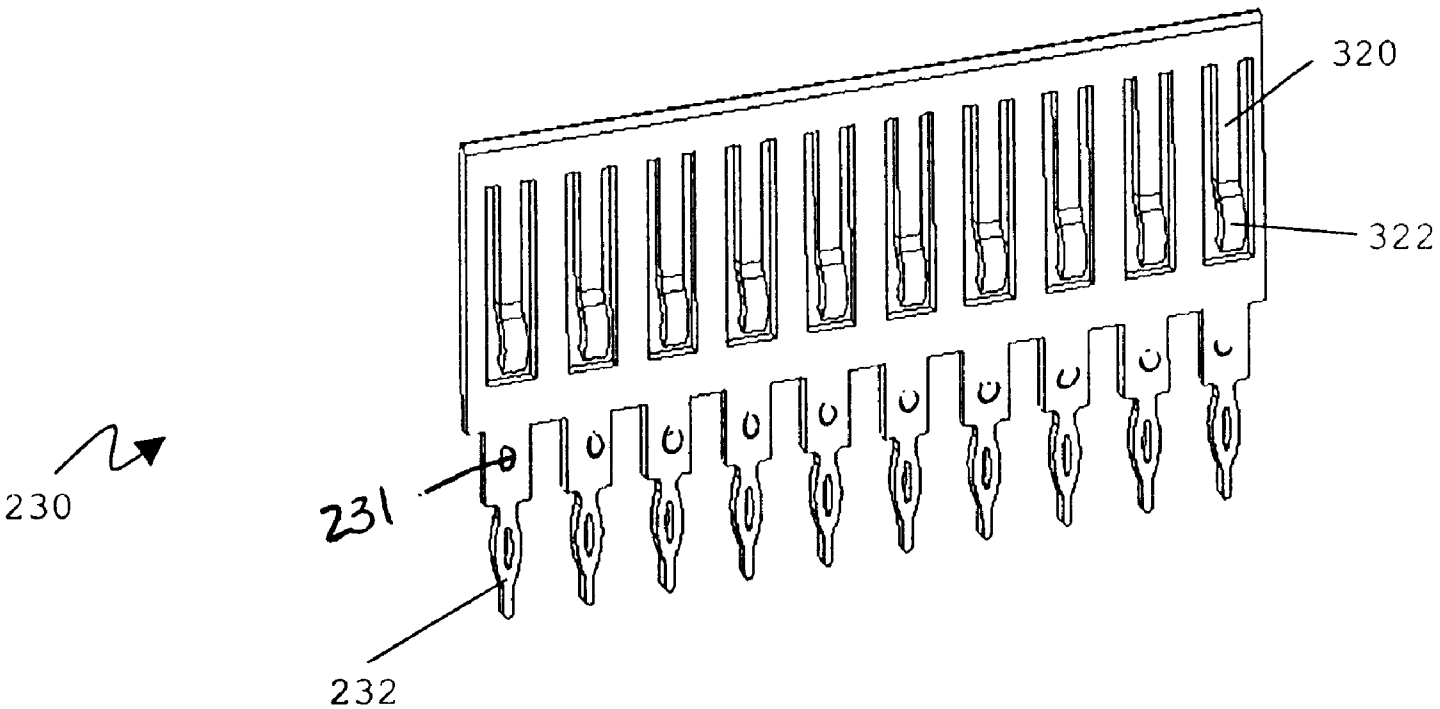
FIG. 10 is an alternate embodiment of the backplane shield plate of FIG. 3.

Referring now to FIG. 10 the backplane shield 230 is formed from a copper alloy such as beryllium copper, brass or phosphor bronze. The shield beams 230 are stamped from the backplane shield 230, and are bent out of the plane of the backplane shield. The shield beams are further fashioned to include a curved or arced region 322 at a distal end of the beam 320.

Figure 11:
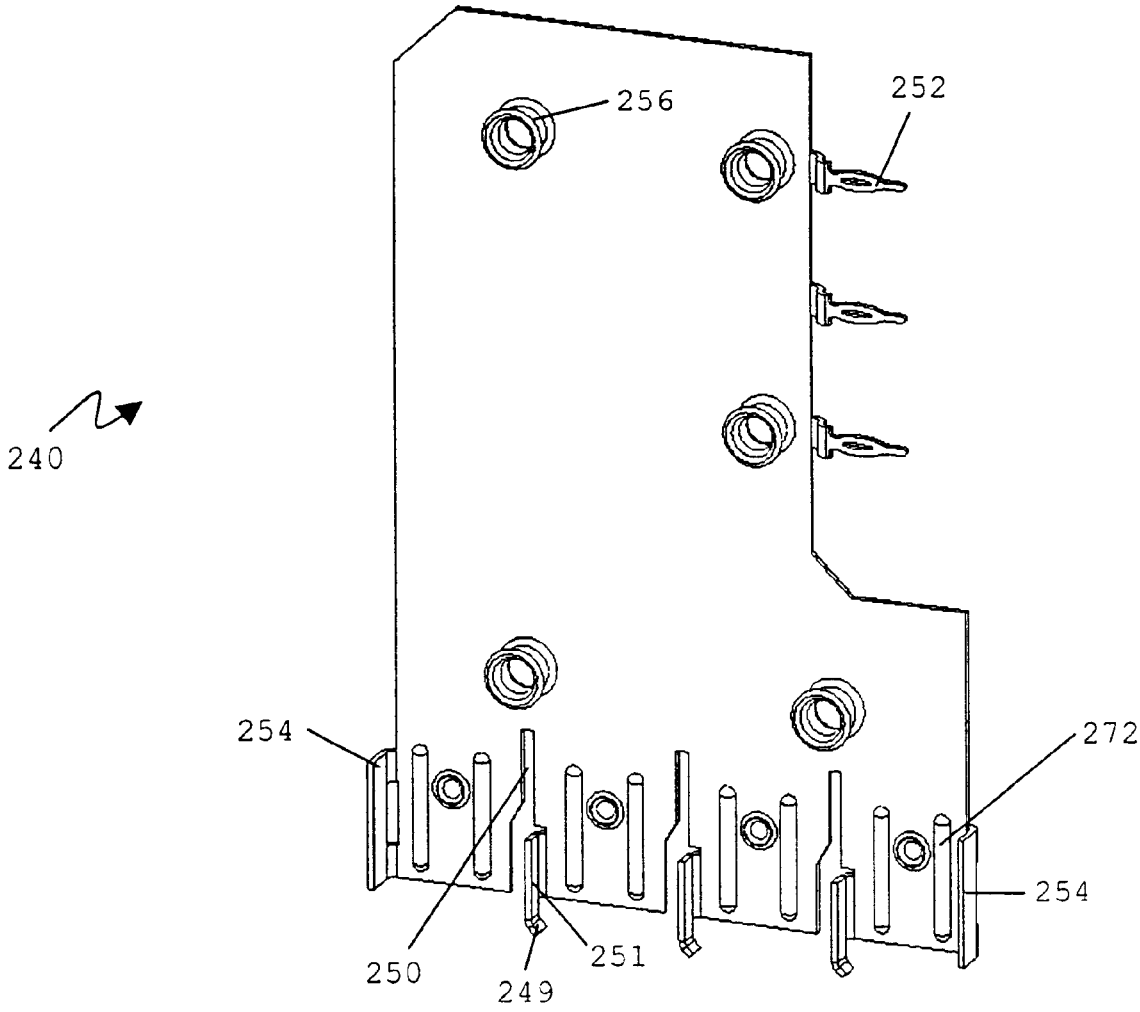
FIG. 11 is an alternate embodiment of the daughter card shield plate of FIG. 5.

Referring also to FIG. 11, the shield 240 of the daughter card connector 210 is shown to include a plurality of mating contacts 250. Each mating contact 250 includes a slot (not numbered) and a daughter card shield beam 251. The daughter card shield beams 251 are stamped from the daughter card shield 240 and bent out of the plane of the shield 240. A distal end of the shield beam 251 is bent to provide a short tab 249 extending from the bottom of the beam 251 at an angle.

When mated, the beveled edge of the backplane shield 230 is inserted into the mating contact 250 of the daughter card shield 240, specifically lodging in the slot of the mating contact 250. An electrical contact is further established as the backplane shield beam 320 engages the daughter card shield beam 251. In a preferred embodiment, the curved region 322 of the backplane shield beam 320 resiliently engages the short tab 249 of the daughter card shield beam 251.

The daughter card shield 240 further includes shield wings 254 disposed at opposite sides of the shield 240 adjacent to the mating contacts 250 and daughter card shield beams 251. The shield wings provide additional protection against cross talk introduced along the edges of the connector proximate to the sidewall grooves 224.

Further included on a face of the daughter card shield 240 are strengthening ribs 272. The strengthening ribs provide additional stability and support to the daughter card shield 240 in view of the forces provided by the mating interface between the two shields 230, 240.

Having described multiple embodiments, numerous alternative embodiments or variations might also be made. For example, the type of contact described for connecting the backplane 110 or daughter card 120 connectors to their respective circuit board 104, 102 are primarily shown and described as being eye of the needle connectors. Other similar connector types may also be used. Specific examples include, surface mount elements, spring contacts, solderable pins etc.

In addition, the shield termination beam contact 150 is described as an arc shaped beam. Other structures may also be conceived to provide the required function such as cantilever beams.

As another example, a differential connector is described in that signal conductors are provided in pairs. Each pair is intended in a preferred embodiment to carry one differential signal. The connector can also be used to carry single ended signals. Alternatively, the connector might be manufactured using the same techniques but with a single signal conductor in place of each pair. The spacing between ground contacts might be reduced in this configuration to make a denser connector.

Also, the connector is described in connection with a right angle daughter card to backplane assembly application. The invention need not be so limited. Similar structures could be used for cable connectors, mezzanine connectors or connectors with other shapes.

Further, the wafers are described as being supported by a metal stiffener. Alternatively, the wafers could be supported by a plastic stiffener or may be glued together.

Variations might also be made to the structure or construction of the insulative housing. While the preferred embodiment is described in conjunction with an insert molding process, the connector might be formed by first molding a housing and then inserting conductive members into the housing.

In addition, other contact structures may be used. For example, opposed beam receptacles may be used instead of the blade and beam mating structures recited. Alternatively, the location of the blades and beams may be reversed. Other variations include changes to the shape of the tails. Solder tails for through-hole attachment might be used or leads for surface mount soldering might be used. Pressure mount tails may be used as well as other forms of attachment.

While this invention has been particularly shown and described with references to preferred embodiments thereof, it will be understood by those skilled in the art that various changes in form and details may be made therein without departing from the scope of the invention encompassed by the appended claims.

What is claimed is:

1. An electrical connector comprising:

first connector piece attachable to a first printed circuit board comprising:

a first array of conductive elements, each conductive element having a first end adapted for being electrically connected to the first circuit board and a second end at which is disposed a first mating contact; and a plurality of first plates disposed between rows of conductive elements of said first array of conductive elements; and a second connector piece attachable to a second printed circuit board comprising:

a second array of conductive elements, each conductive element having a first end adapted for being electrically connected to the second circuit board and a second end at which is disposed a second mating contact; and a plurality of second plates disposed between columns of conductive elements of said second array of conductive elements and perpendicular to said plurality of first plates when said first connector piece and said second connector piece are mated.

2. The electrical connector of claim 1 wherein the first and second array of conductive elements are electrically grouped in pairs to provide a differential signal therefrom.

3. The electrical connector of claim 1, wherein for said second connector piece, height of each of said plurality of second plates is greater than height of each conductive element of said second array of conductive elements.

4. The electrical connector of claim 1 wherein each of said plurality of first plates is substantially planar and includes:

a first end at which is disposed a plurality of spring-force contacts, said plurality of spring-force contacts being displaced from the plane of said each of said plurality of first plates;

a second end adapted for being electrically connected to said first circuit board; and a pair of wings disposed at opposing edges of said first end, said pair of wings being displaced from the plane of said each of said plurality of first plates.

5. The electrical connector of claim 4 wherein each of said plurality of second plates includes:

a first end adapted for being electrically connected to said second circuit board; and a second end adapted to be received by one of said plurality of spring-force contacts from said each of said plurality of first plates.

6. The electrical connector of claim 4 wherein the plurality of spring-force contacts electrically engage said second plate.

7. The electrical connector of claim 4, wherein for each row of conductive elements of said first array of conductive elements, the first ends lie along a same line as the second ends of one of said plurality of first plates.

8. The electrical connector of claim 4, said first connector piece further comprising:

a plurality of insulative housings, each of said insulative housings supporting a row of said first array of conductive elements.

9. The electrical connector of claim 8, wherein of said plurality of first plates is partially housed in insulative material and said insulative material defines a plurality of cavities, each adapted to support one of said first mating contacts.

10. The electrical connector of claim 8 wherein each of said plurality of first plates further includes:

a plurality of eyelets; and each of said plurality of insulative housings is adapted to receive said plurality of eyelets from one of said plurality of first plates.

11. The electrical connector of claim 10 further comprising:

a metal stiffener supporting said plurality of insulative housings.

12. An electrical connector with a first connector piece attachable to a first printed circuit board and having a plurality of rows of first signal conductors and a second connector piece attachable to a second printed circuit board and having a plurality of columns of second signal conductors adapted to mate to the first signal conductors when the first connector piece and the second connector piece are mated, characterized in that the connector further comprises:

a first plurality of plates, each disposed between adjacent rows of first signal conductors in the first connector piece;

a second plurality of plates, each disposed between adjacent columns of second signal conductors in the second connector piece; and a first plurality of mating contacts on the first plurality of plates, wherein when the first connector piece and the second connector piece are mated, the first plurality of plates is perpendicular to and makes contact with the second plurality of plates.

13. The electrical connector of claim 12 wherein each of said plurality of second plates is substantially planar and includes:

a first end at which is disposed a plurality of second mating contacts, said plurality of mating contacts being displaced from the plane of said each of said first plurality of plates;

a second end adapted for being electrically connected to a first circuit board; and a pair of wings disposed at opposing edges of said first end, said pair of wings being displaced from the plane of said each of said first plurality of plates.

14. The electrical connector of claim 13 wherein each of said plurality of first plates includes:

a first end adapted for being electrically connected to a second circuit board.

15. The connector of claim 13 further comprising:

a stiffener; and a plurality of insulative housings, each of said plurality of insulative housings supporting one of said plurality of columns of second signal conductors, each of the insulative housings having a front face facing the first connector piece and a rear portion attached to the stiffener.

16. The electrical connector of claim 15 wherein each of said plurality of second plates further includes:

a plurality of eyelets; and each of said plurality of insulative housings is adapted to receive said plurality of eyelets from one of said plurality of second plates.

17. A shielding arrangement for an electrical connector assembly including a plurality of signal conductors, the arrangement comprising:

a first plurality of plates disposed in a first connector attachable to a first printed circuit board; and a second plurality of plates disposed in a second connector attachable to a second printed circuit board, said second plurality of plates being perpendicular to said first plurality of plates when said first connector and said second connector are mated;

wherein each one of said plurality of signal conductors is disposed within one of a plurality of grid cells formed by said mated first and second plurality of plates.

18. The arrangement of claim 17 wherein each of said plurality of first plates is substantially planar and includes:

a first end at which is disposed a plurality of first mating contacts, said plurality of mating contacts being displaced from the plane of said each of said first plurality of plates;

a second end adapted for being electrically connected to the first printed circuit board; and a pair of wings disposed at opposing edges of said first end, said pair of wings being displaced from the plane of said each of said first plurality of plates.

19. The arrangement of claim 18 wherein each of said plurality of first plates further includes:

a plurality of eyelets; and each of said plurality of insulative housings is adapted to receive said plurality of eyelets from one of said plurality of second plates.

20. The arrangement of claim 19 wherein each of said plurality of second plates includes:

a first end adapted for being electrically connector to the second printed circuit board; and a second mating contact adapted to be received by one of said plurality of first mating contacts from said each of said plurality of second plates.

21. A method for providing cross-talk shielding to an array of signal conductors in an electrical connector, the method comprising:

providing a plurality of plates disposed in a grid pattern, each of said signal conductors being isolated from adjacent signal conductors by two or more of said plates and wherein providing a plurality of plates includes:

providing a first set of said plurality of plates in a first piece of the electrical connector attachable to a first printed circuit board; and providing a second set of said plurality of plates in a second piece of the electrical connector attachable to a second printed circuit board.

22. A method for providing cross-talk shielding to a grid array of signal conductors in an electrical connector, the method comprising:

providing a shield plate between each signal conductor and an adjacent signal conductor in a longitudinal direction in a first piece of the electrical connector attachable to a first printed circuit board; and providing a shield plate between each signal conductor and an adjacent signal conductor in a latitudinal direction in a second piece of the electrical connector attachable to a second printed circuit board.

* * * * *